United States Patent [19]

Simpson et al.

[11] 4,049,344

[45] Sept. 20, 1977

[54] ELECTROSTATIC IMAGING SYSTEM

[75] Inventors: George R. Simpson, Rochester; Robert W. Gundlach, Victor, both of N.Y.; Gordon C. Butler, Welwyn Garden City, England

[73] Assignee: Xerox Corporation, Stamford, Conn.

[21] Appl. No.: 557,213

[22] Filed: Mar. 10, 1975

[51] Int. Cl.[2] ..... G03G 13/10; G03G 13/22

[52] U.S. Cl. ..... 355/10; 96/1 LY; 355/3 R

[58] Field of Search ..... 355/3 BE, 10, 15; 96/1 LY

[56] References Cited

U.S. PATENT DOCUMENTS

| | | | |
|---|---|---|---|
| 3,420,151 | 1/1969 | Levine et al. | 355/10 |
| 3,712,728 | 1/1973 | Whittaker | 355/10 |
| 3,719,481 | 3/1973 | Makino et al. | 355/3 BE |
| 3,722,992 | 3/1973 | Zweig | 355/3 BE |
| 3,743,410 | 7/1973 | Edelman et al. | 355/15 |
| 3,778,841 | 12/1973 | Gundlach et al. | 355/3 BE |
| 3,820,985 | 6/1974 | Gaynor et al. | 355/3 BE |
| 3,914,045 | 10/1975 | Namiki et al. | 355/15 |

OTHER PUBLICATIONS

Volkers; *Xerox Disclosure Journal;* vol. 1, No. 6, pp. 29–30, June 1976.

*Primary Examiner*—L. T. Hix
*Assistant Examiner*—J. A. LaBarre
*Attorney, Agent, or Firm*—James J. Ralabate; Ernest F. Chapman

[57] ABSTRACT

An apparatus and method for developing a selected image by the electrostatic attraction of development fluid is disclosed. The system utilizes an interposer, adapted to be movably superimposed over a photoreceptor which preferably comprises the outer surface of a rotatable drum. A source of electrostatic charge for applying a first charge of a selected polarity to an area of the photoreceptor, and optical system for subsequently applying a light and shadow representation of the selected image to the area of the photoreceptor are also provided. The system further includes a source of electrostatic charge for applying a second charge, opposite in polarity from the first charge, to a portion of the interposer superimposed over the area of the photoreceptor. The portion of the photoreceptor is adapted to receive a quantity of electrostatic fluid, corresponding to the light and shadow representation applied by the optical system, when moved out of superimposition with the photoreceptor. A transfer station for transferring development fluid from the interposer to a copy medium is also provided, whereby the selected image is reproduced on the copy medium.

17 Claims, 8 Drawing Figures

ELECTROSTATIC IMAGING SYSTEM

BACKGROUND OF THE INVENTION

This invention relates to an apparatus and method for electrostatically reproducing a selected image, and in particular, relates to an electrostatic imaging system utilizing a development fluid such as liquid ink for recording an image onto a copying medium.

Fluid development of electrostatic images is not new, an early system embodying such a concept being disclosed in U. S. Pat. No. 3,084,043 issued to R. W. Gundlach on Apr. 2, 1953 and assigned to the instant assignee. Though specific prior art fluid development systems vary, a typical apparatus may include a rotatably rum having a photoconducting surface and an electrically conductive substrate. A transparent interposer may be belted between a roller and the rotatably drum thereby contacting a portion of the photoconducting surface at all times.

In such liquid development systems, a portion of the photoconducting surface, not then rotated into contact with the transparent interposer, is electrostatically charged by any suitable means. The charged portion of the photoconducting surface is then subjected to a positive or negative light and shadow representation of the image to be developed. As a result, the charged portion of the photoconductive surface is discharged through the conductive substrate at points struck by the lighted portion of the light and shadown representation of the selected image. Accordingly, the original charge applied to the photoconducting surface, upon receipt of the light and shadow representation, assumes a pattern corresponding to a positive or negative image of the image to be developed.

Electrostatic imaging systems of the prior art further include a source of development fluid, and means such as an intricately patterned gravure roll, adapted to receive metered amounts of fluid from said source. The gravure roll is typically disposed near the periphery of the rotatable drum, at a point where the transparent interposer is out of contact with the photoconducting surface. As the interposer is compressed between the gravure roll and a back-up roller, development fluid is electrostatically attracted to the portion of the interposer corresponding to the charged portion of the photoconducting surface.

The fluid-carrying interposer is then moved into contact with a copying medium such as a sheet of copy paper. A pressure roller, adapted to urge the paper against the interposer, facilitates passage of the development fluid to the paper. Since the development fluid carried on the interposer is typically in the form of the selected image, that image is faithfully transferred from the interposer to the paper. After development the photoconducting surface is discharged through the conductive substrate, thereby eliminating any residual electrostatic charge remaining on the photoconducting surface. At substantially the same time, excess development fluid on the transparent interposer is removed by means such as a doctor blade, thereby readying the apparatus for the subsequent development of other selected images.

Though fluid development systems of the type described have been used to reprodced selected images, they are subject to numerous drawbacks and deficiencies. For example, it has been found that the gravure roll adapted to transfer development fluid to the interposer is preferably fabricated from a hardened metal such as steel, brass, etc., in order to maintain the intergrity of the intricately patterned gravure surface. Structural hardness is also desirable to provide a sufficiently durable gravure. However, when the hardened metal gravure roll comes into contact with the interposer during the transfer of development fluid, damage to the interposer frequently occurs. Moreover, though the interposer tends to cushion the forces applied to the rotatable drum by the hardened gravure roll, such forces often impair the glass-like finish of the photoconducting surface. Attempts to militate against these adverse effects to the photconducting surface by providing a resilient undercoating therefor are costly and difficult to achieve.

Another drawback in the prior art fluid development systems of the type described results from the manner in which the development fluid on the interposer is transferred to the copy paper. More particularly, upon development, the copy paper tends to adhere to the fluid-carrying interposer, and thus follow the rotation of the necessarily large-diameter drum. This is, of course, undesirably since, instead of following the interposer inside the apparatus, the developed copy paper should be passed to an outlet chute where it can be retrieved by an attendant. Though mechanical means, such as pick-off fingers and the like have generally been deployed to strip the copy paper off the interposer, they increase the cost of the apparatus, and diminish reliability to the extend that they are not 100 percent effective.

As explained in greater detail, below, the apparatus and method disclosed herein overcome these and other drawbacks and deficiencies in the fluid development systems of the prior art.

SUMMARY OF THE INVENTION

The improved apparatus for electrostatically reproducing a selected image comprises an interposer adapted to be movably superimposed over a portion of a photoreceptor. The apparatus further includes first charge means for applying a first charge of a selected polarity to an area of the photoreceptor, and optical means for applying a light and shadow representation of the selected image to that area of the photoreceptor. Second charge means apply a second charge, of opposite polarity from the first charge, to a portion of the interposer superimposed over the charged area of the photoreceptor. That portion of the interposer is adapted to receive a quantity of development fluid, corresponding to the light and shadow representation applied by the optical means, when moved out of superimposition with the photoreceptor. The apparatus further includes means for transferring development fluid in image configuration from the interposer to a copy medium, whereby the image is reproduced on the copy medium.

The method of the invention for electrostatically reproducing a selected image comprises the steps of applying a first charge, having a selected polarity, to an area of a photoconducting drum; applying a light and shadow representation, to the interposer; and transferring the development fluid from the interposer to a copying medium.

BRIEF DESCRIPTION OF THE DRAWINGS

The apparatus and method of the invention can best be understood by reading the following detailed description in conjunction with the accompanying drawings in which.

DETAILED DESCRIPTION OF AN EXEMPLARY EMBODIMENT

An exemplary embodiment of the electrostatic imaging system, includes a rotatably drum having a photoconducting surface and a conductive substrate. Briefly summarizing the operation, a portion of the photoconducting surface is subjected to an electrostatic charge such as point A of FIG. 1 to uniformly charge the surface at a desired polarity. At point B, a light and shadow representation of a selected image is applied through a transparent interposer to the photoconducting surface. The interposer is then subjected to another uniform electrostatic charge at C, opposite in polarity to that applied to the photoconducting surface at A. The charge applied to the interposer conforms to the light and shadow representation of the selected image, and remains on the interposer after it separates from the photoconducting surface.

At point D, development fluid such as liquid ink, is attracted to the interposer from an intricately patterned gravure roll in conformity with the charge imposed on the interposer. Thereafter, the development fluid is transferred to a copy paper at E, and excess ink is doctored from the interposer at F. Residual charges on the interposer and the photoconducting surface are removed at F and G, respectively, thereby readying the system for developing subsequent images.

From this brief summary, it should be clear that the gravure roll never contacts the photoconducting surface, and thus cannot cause any damage thereto. Further, because the interposer is not in contact with the rotatable drum when ink is transferred to the copy paper, a relatively small diameter pressure roller can be used at point E, thereby reducing the tendency of the copy paper to follow the interposer. As a result, mechanical means, such as pick-off fingers or the like, are unnecessary to insure passage of the copy paper to an outlet chute.

Figure 1:
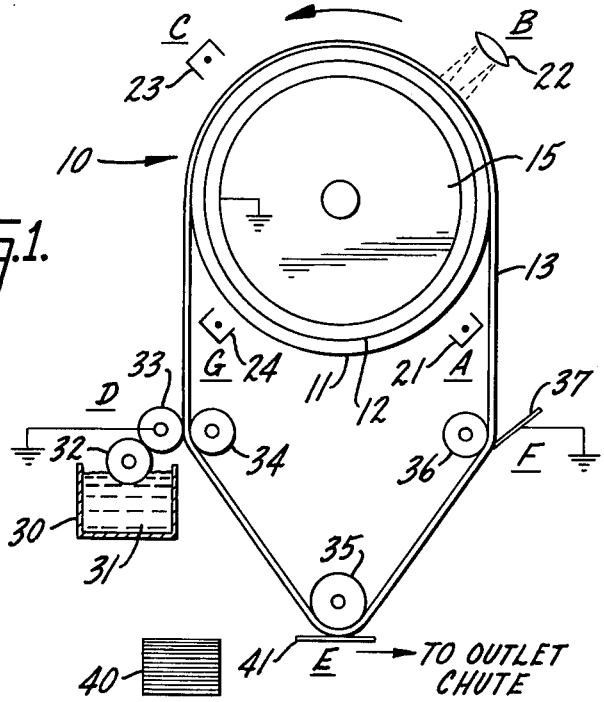
FIG. 1 is a schematic illustration of the electrostatic imaging system of the invention.

Other features and advantages of the invention will be apparent upon referring to FIG. 1, which shows an exemplary apparatus for fluid development of electrostatic images identified generally by reference numeral 10. Apparatus 10 includes a rotatable drum 15 having a photoreceptor in the form of a photoconducting surface 11. Surface 11 may be fabricated from any photoconducting material such as a 50 micron layer of Selenium. Underlying photoconducting surface 11 is a conductive substrate 12 which, for reasons that will be explained hereinafter, is coupled to a source of low potential sometimes referred to as ground.

A transparent, non-conductive interposer 13, which may be fabricated from a 25 micron thickness of Tedlar, Nylon, polypropylene or the like, is secured around drum 15 and a relatively small-diameter pressure roller 35 to form an endless belt movable upon rotation of drum 15. As it moves around pressure roller 35 and drum 15, interposer 13 passes between a gravure roll 33 and a cushioned backup roller 34. Interposer 13 also passes between a second backup roller 36 and a grounded doctor blade 37.

Figure 2:
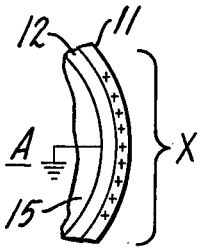
FIG. 2 illustrates the electrostatic charge distribution on a portion of the apparatus at point A of FIG. 1.

Apparatus 10 further includes a source of electrostatic charges such as a corona discharge unit 21 disposed at point A in FIG. 1. Discharge unit 21 is adapted to apply a positive electrostatic charge to an area X on photoconducting surface 11, as illustrated in FIG. 2. It should be emphasized, however, that the polarity of the charges applied by corona unit 21, and by other elements of apparatus 10 as may be described subsequently herein, are exemplary only and should not be construed as limitative.

Figure 3:
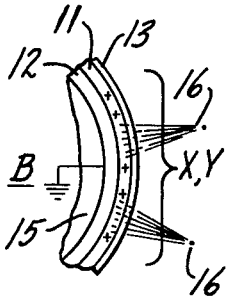
FIG. 3 illustrates the electrostatic charge distribution on a portion of the apparatus at point B of FIG. 1.

After being positively corona charged at a point A, area X of photoconducting surface 11 moves in the direction of the arrow until interposer 13 is superimposed thereon. A portion Y of interposer 13 then follows area X of photoconducting surface 11 around drum 15 to point B. At point B, a light and shadow representation of a selected image produced by optical means 22 is passed through portion Y of interposer 13 to area X of photoconducting surface 11. As shown in FIG. 3, the light 16 from optical means 22 causes corresponding positive charges imposed on photoconducting surface 11 to be discharged through conducting substrate 12. Of course, in accordance with well-known principles of photoconduction, the positive charges corresponding to the unilluminated portions of area X remain thereon. Thus, in this exemplary embodiment, area X of photoconduction surface 11 retains a pattern of positive charges corresponding to the image to be developed.

Figure 4:
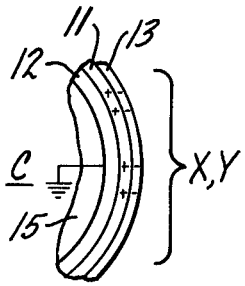
FIG. 4 illustrates the electrostatic charge distribution on a portion of the apparatus at point C of FIG. 1.

Superimposed portion Y of interposer 13 continues to follow area X of photoconducting surface 11 about drum 15 until reaching point C. At point C, a second corona discharge device 23 provides a source of electrostatic charges, at least some of which are opposite in polarity from those produced by corona device 21. Thus, in this exemplary embodiment at least some of the charges produced by corona device 23 have a negative polarity. Some of these negative charges impinge interposer 13 and, as shown in FIG. 4, are retained thereon by the attractive force from the charge already on photoconducting surface 11. Accordingly, the negative charges on portion Y of interposer 13 correspond to the same pattern as the positive charges on area X of photoconducting surface 11.

After the negative charges produced by corona unit 23 are applied to interposer 13, the interposer separates from drum 15 and photoconducting surface 11. During this separation, fields extending through the air gap between interposer 13 and photoconducting surface 11 are sufficient to cause ionization in the air, resulting in positive charges effectively transferring from photoconducting surface 11 to the inner surface of interposer 13. The negative charges on the outer surface thereof, however, are retained on the interposer even after separation from drum 15. Since these charges facilitate the development of the selected image, it is clear that the second charge means, such as corona device 23, should be located between the point B where imaging occurs, and the point where interposer 13 separates from drum 15.

As explained hereinbefore, and shown at point D, interposer 13 moves between gravure roll 33 and conducting, cushioned backup roller 34 after separating from drum 15. Cravure roll 33, in accordance with well-known fluid development principles, is intricately patterned with grooves, recesses or pockets adapted to carry development fluid such as liquid ink 31. Ink 31 may be stored in a container 30, and applied to gravure roll 33 by means of an applicator roller 32. As shown in FIG. 1, gravure roll 33 is coupled to ground, thereby establishing a positive gradient between the surface of the ink contained in the pockets in the gravure and the negative charges on interposer 13. The ink carried by gravure 33 will be positively charged by induction in this example, and it is attracted to the negative interposer 13.

Gravure roll 33 is preferably fabricated from hardened metal such as steel or brass to maintain the integrity of its intricately patterned surface. However, as shown in FIG. 1, the hardened metal gravure does not contact photoconducting surface 11 directly, or even indirectly through interposer 13. As a result, no damage to the photoconducting surface can occur. Moreover, because conductive, backup roller 34 is cushioned, such as by depositing a layer of soft, resilient material about the periphery, the potentially damaging effects to the interposer by the hardened metal gravure roll are greatly reduced.

Figure 5:
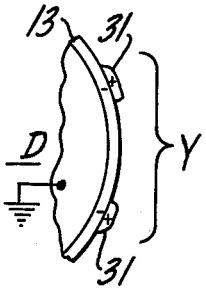
FIG. 5 illustrates the application of development fluid to the interposer at point D of FIG. 1.
Figure 6:
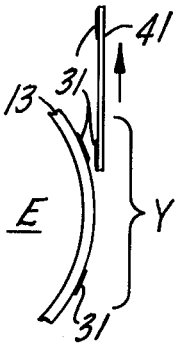
FIG. 6 illustrates the transfer of developer fluid to a copy medium, e.g., paper, at point E of FIG. 1.

As illustrated in FIG. 5, ink 31 from gravure roll 33 is attracted to the negative charges on portion Y of interposer 13. Since the distribution of the negative charges on the interposer corresponds to the positive charges retained on area X of photoconducting surface 11, the ink attracted to interposer 13 conforms to the image to be developed and development of the image takes place at point D. Transfer occurs at point E, shown in FIG. 6, where a copy medium such as a sheet of paper 41 is urged against the inked interposer by pressure roller 35. Accordingly, the selected image as represented by the pattern of ink on interposer 11 is transferred to copy paper 41.

The copy paper is typically supplied from a stack 40 by conventional means (not shown) adapted to sequentially pass individual sheets into contact with the interposer at timed intervals in a manner well-known in the art. Thereafter, the paper can be passed to an outlet chute or the like, where it is retrieved by an attendant. Since pressure roller 35 has a small diameter relative to the size of paper 41, and preferably a diameter of about 1 to 2 inches (2.54 – 5.08 cm), the beam strength of the paper will produce a self-stripping effect sufficient to prevent the paper from adhering to the inked interposer. Accordingly, mechanical means such as pick-off fingers and the like are unnecessary to insure passage of paper 41 to the outlet chute.

Figure 7:
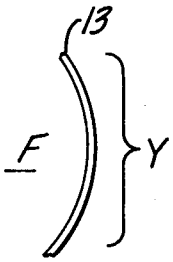
FIG. 7 illustrates the electrostatic charge distribution on a portion of the apparatus at point F of FIG. 1.

After transferring ink to paper 41, portion Y of interposer 13 is moved into contact with a grounded doctor blade 37 at point F. Backed by roller 36, doctor blade 37 wipes excess ink from the interposer. Moreover, because doctor blade 37 is coupled to ground, a discharge path for residual charges on interposer 13 is provided. Thus, as shown in FIG. 7, after passing point F, interposer 13 is free from excess ink and spurious electrostatic charges which would interfere with a subsequent development cycle.

Figure 8:
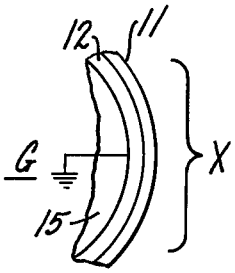
FIG. 8 illustrates the electrostatic charge distribution on a portion of the apparatus at point G of FIG. 1.

Residual charges on area X of photoconducting surface 11 are also removed prior to the next development cycle. This occurs at point G, and is illustrated by FIG. 8. In the exemplary embodiment, charge removal is effected by a fluorescent discharge lamp 24 which causes any remaining charges on photoconducting surface 11 to be discharged through conductive substrate 12. After discharge at point G, the photoconducting surface 11 is ready to be recharged by corona device 21 at point A, thereby commencing another development cycle.

Though the exemplary embodiment of the electrostatic imaging system described herein is preferred, it will be apparent to those skilled in the art that numerous modifications and refinements can be made without departing from the true scope of the invention. However, all such modifications and refinements are intended to be covered by the appended claims.

What is claimed is:

1. An apparatus for electrostatically reproducing a selected image consisting essentially of:

photoreceptor means;

interposer means adapted to be movable superimposed over a portion of said photoreceptor means;

first charge means for applying a first charge of a selected polarity to an area of said photoreceptor means;

optical means for applying a light and shadow representation of said selected image to said area of said photoreceptor means;

second charge means for applying a second charge, of opposite polarity from said first charge, to a portion of said interposer means superimposed over said area of said photoreceptor means, said portion of said interposer means being adapted to receive a quantity of development fluid corresponding to the light and shadow representation applied by said optical means when moved out of superimposition with said photoreceptor means, the second charge being retained on the interposer according to the light and shadow representation and the first charge effectively transferring from the photoreceptor means to the interposer when the interposer moves out of superimposition with the photoreceptor means; and means for transferring development fluid from said interposer means to a copy medium, whereby said image is reproduced on a copy medium.

2. The apparatus recited in claim 1 further includes discharge means adapted to remove residual charges of said first charge from said photoreceptor means prior to the application of another light and shadow representation on said area of photoreceptor means.

3. The apparatus recited in claim 1 further includes means for removing excess development fluid from said interposer means after said image is reproduced on a copy medium.

4. The apparatus recited in claim 1 further includes development fluid dispensing means for passing development fluid to said interposer means.

5. The apparatus recited in claim 5 wherein said development fluid dispensing means include a patterned roll.

6. The apparatus recited in claim 5 further includes a resilient backup roller disposed in spaced relationship with said patterned roll, said interposer means being adapted to pass between said patterned roll and said backup roller.

7. The apparatus recited in claim 1 wherein said means for transferring development fluid from said interposer means include a pressure roller adapted to urge said interposer into contact with a copy medium.

8. The apparatus recited in claim 7 wherein said pressure roller has a diameter less than the length of the copy medium.

9. An apparatus for electrostatically reproducing a selected image comprising:

a rotatable photoconducting drum;

endless interposer means belted about said drum and adapted to movably contact portions thereof;

first charge means for applying a first charge of a selected polarity to an area of said drum;

optical means for applying a light and shadow representation of said selected image to said area to said drum;

second charge means for applying a second charge of opposite polarity from said first charge, to a portion of said interposer means in contact with said area of said drum, the second charge being retained on the interposer according to the light and shadow representation and the first charge effectively transferring from the photoconducting drum to the interposer when the interposer moves out of contact with the drum;

development fluid dispensing means adapted to pass a quantity of development fluid corresponding to said light and shadow representation applied by said optical means to said portion of said interposer means when moved out of contact with said drum;

a pressure roller, adapted to urge said interposer means into contact with a copy medium for transferring said development fluids thereto;

discharge means adapted to remove residual charges of said first charge from said drum prior to the application of another light and shadow representation on said area of said drum; and means for removing excess development fluid from said interposer means after said image is reproduced on a copy medium.

10. The apparatus recited in claim 9 wherein said development fluid dispensing means include a patterned roll.

11. The apparatus recited in claim 9 further includes means for advancing a copy medium into contact with said pressure roller.

12. The apparatus recited in claim 11 wherein said pressure roller has a diameter less than the length of the copy medium.

13. The apparatus recited in claim 9 wherein said means for removing excess development fluid from said interposer means are grounded for removing the charge on said interposer means.

14. A method for electrostatically reproducing a selected image comprising the steps of:

a. applying a first charge having a selected polarity to an area on a photoconducting drum;

b. applying a light and shadow representation of said image to said area on said drum;

c. applying a second charge, of opposite polarity from that of said first charge, to a portion of an interposer movably superimposed over said area on said drum, the second charge being retained on the interposer according to the light and shadow representation and the first charge effectively transferring from the photoconducting drum to the interposer when the interposer moves out of contact with the drum and leaving residual charges on the drum;

d. moving said portion of said interposer out of superimposition with said drum;

e. applying a quantity of development fluid, corresponding to said light and shadow representation, to said interposer; and f. transferring said development fluid from said interposer to a copying medium.

15. The method recited in claim 14 further including, after step (d), the step of:

g. removing the residual charge of the charge applied to said area of said drum.

16. The method recited in claim 14 further including, after step (f), the step of:

h. removing the charge applied to said interposer.

17. The method recited in claim 14 further including, after step (f), the step of:

i. removing excess development fluid from said interposer.

* * * * *